United States Patent [19]

Hanada et al.

[11] 4,255,505

[45] Mar. 10, 1981

[54] ELECTROPHOTOGRAPHIC PROCESS USING LAYERED ELEMENT CONTAINING P-TYPE OR N-TYPE MATERIALS, WITH MULTIPLE CHARGING STEPS AND BLANKET IRRADIATION

[75] Inventors: Hiroshi Hanada, Yokohama; Nobuo Kitajima, Akishima; Tatsuo Masaki, Tokyo, all of Japan

[73] Assignee: Canon Kabushiki Kaisha, Tokyo, Japan

[21] Appl. No.: 929,242

[22] Filed: Jul. 31, 1978

Related U.S. Application Data

[63] Continuation of Ser. No. 755,026, Dec. 29, 1976, abandoned, which is a continuation of Ser. No. 419,043, Nov. 26, 1973, abandoned, which is a continuation of Ser. No. 87,425, Nov. 6, 1970, abandoned.

[30] Foreign Application Priority Data

| | | | |
|---|---|---|---|
| Nov. 11, 1969 | [JP] | Japan | 44-90312 |
| Nov. 17, 1969 | [JP] | Japan | 44-92335 |
| Nov. 27, 1969 | [JP] | Japan | 44-95296 |

[51] Int. Cl.[3] ..... G03G 5/14; G03G 13/22

[52] U.S. Cl. ..... 430/31; 430/42; 430/902; 430/65; 430/67; 430/85; 355/3 CH

[58] Field of Search ..... 430/31, 42, 65, 67, 430/85; 355/3 CH

[56] References Cited

U.S. PATENT DOCUMENTS

| | | | |
|---|---|---|---|
| 2,687,484 | 8/1954 | Weimer | 96/1.5 |
| 2,745,327 | 5/1956 | Mengali | 117/34 |
| 2,833,675 | 5/1958 | Weimer | 117/201 |
| 3,041,166 | 6/1962 | Bardeen | 96/1 R |
| 3,170,790 | 2/1965 | Clark | 96/1.5 X |
| 3,174,855 | 3/1965 | Gray | 96/1.5 X |
| 3,312,547 | 4/1967 | Levy | 96/1.5 |
| 3,457,070 | 7/1969 | Watanabe et al. | 96/1 R X |

FOREIGN PATENT DOCUMENTS

| | | | |
|---|---|---|---|
| 38-14895 | 8/1963 | Japan | 96/1.5 |
| 38-17247 | 9/1963 | Japan | 96/1.5 |
| 38-20697 | 10/1963 | Japan | 96/1.5 |

OTHER PUBLICATIONS

Dessauer et al., Xerography, 1965, pp. 96–97.

Claus, "Advances in Xerography", Photog. Sci & Eng. vol. 7, No. 1, Jan.-Feb. 1963., pp. 5–14.

Keck, "Photoconductivity in Vacuum Coated Selenium Films", J. Opt. Soc. of Amer. vol. 42, No. 4, Apr. 1952, pp. 221–225.

*Primary Examiner*—John D. Welsh

*Attorney, Agent, or Firm*—Fitzpatrick, Cella, Harper & Scinto

[57] ABSTRACT

An electrophotographic photosensitive member comprises a base, a photoconductive layer and an insulating layer, and the photoconductive layer contains an intermediate layer formed at the base side of the photoconductive layer. The intermediate layer facilitates injection of electric charge.

4 Claims, 5 Drawing Figures

ELECTROPHOTOGRAPHIC PROCESS USING LAYERED ELEMENT CONTAINING P-TYPE OR N-TYPE MATERIALS, WITH MULTIPLE CHARGING STEPS AND BLANKET IRRADIATION

This is a continuation of application Ser. No. 755,026 filed Dec. 29, 1976, now abandoned, which in turn is a continuation of Ser. No. 419,043 filed Nov. 26, 1973, now abandoned, which in turn is a continuation of Ser. No. 87,425 filed Nov. 6, 1970, now abandoned.

This invention relates to an electrophotographic photosensitive member, and more particularly, to an electrophotographic photosensitive member suitable for electrophotographic processes which comprises primary charging, secondary charging contemporaneously with exposure and whole surface irradiation.

The above-mentioned electrophotographic processes are disclosed in U.S. Ser. No. 563,899 filed July 8, 1966, and U.S. Ser. No. 571,538 filed Aug. 10, 1966, now abandoned, and there has been already proposed a three-layer photosensitive member mainly composed of a base, a photoconductive layer and an insulating layer for such electrophotographic processes.

The photosensitive member is subjected to primary charge to charge positively the surface of the insulating layer when the photconductive material is of n-type or charge negatively the surface of the insulating layer when the photoconductive material is of p-type, and charge of opposite polarity is bound to neighborhood of interface between the photoconductive layer and the insulating layer and in the photoconductive layer. Further, the resulting photosensitive member is subjected to corona charging of polarity opposite to the primary charge or A.C. discharging contemporaneously with imagewise exposure to release the charge at a portion corresponding to the light portion of the original pattern, and then the photosensitive member is subjected to a blanket irradiation to increase electrostatic contrast and form electrostatic images.

In primary charging of such a process as above, degree of injection of electric charge from the base and degree of binding of the electric charge thus injected are very important factors.

Heretofore, for the purpose of improving such factors, interfacial state or uniformity of the photoconductive layer or laminating state of the photoconductive layer with the insulating layer and the base has been studied and treated. These may be one means for improvement, but can neither attain a fundamental improvement nor sufficiently improve the injection state and the binding state. The transfer of charge such as injection and binding, is affected by the state of lamination, and more fundamentally, the problem resides in the photoconductive material itself, that is, a photoconductive material of easy binding is not always that of easily receiving injection and vice, versa. Therefore, conventional photosensitive member is considerably limited with respect to injection and binding of charge.

An object of this invention is to provide a photosensitive member free from the above-mentioned fundamental disadvantage.

Another object of this invention is to provide a photosensitive member capable of forming good electrostatic images.

A further object of this invention is to provide a photosensitive member of high sensitivity and high panchromatic property.

Still another object of this invention is to enhance the electric charge binding ability of photosensitive layer.

A further understanding of the invention will be presented in the following specification and in the drawings in which.

Figure 1:
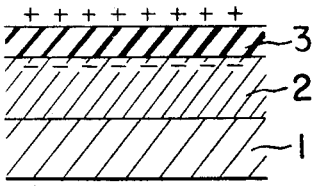
FIG. 1 shows an enlarged diagrammatic cross-section view of a conventional photosensitive member.
Figure 3:
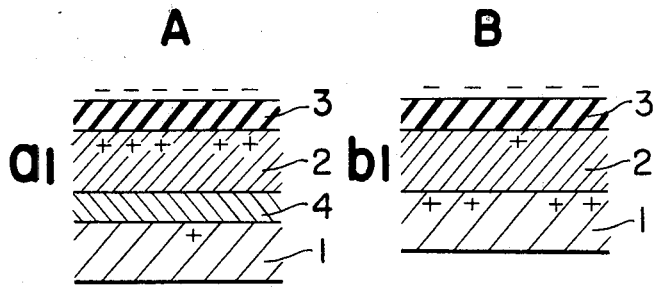
Figure 2:
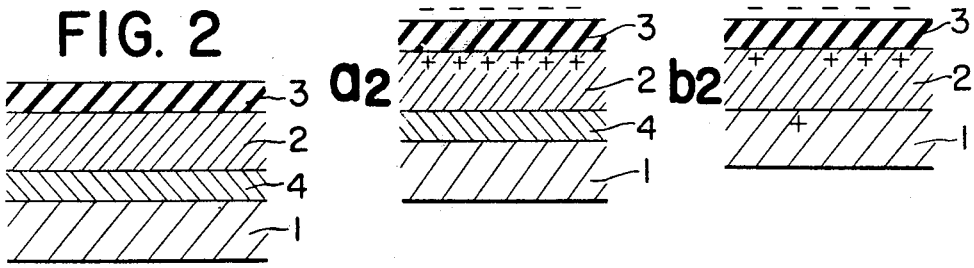
FIG. 2 is an enlarged diagrammatic cross-section of an embodiment of photosensitive device according to this invention.
Figure 4:
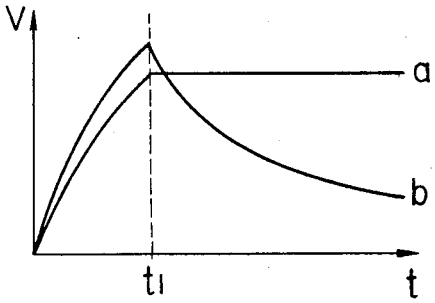
Figure 5:
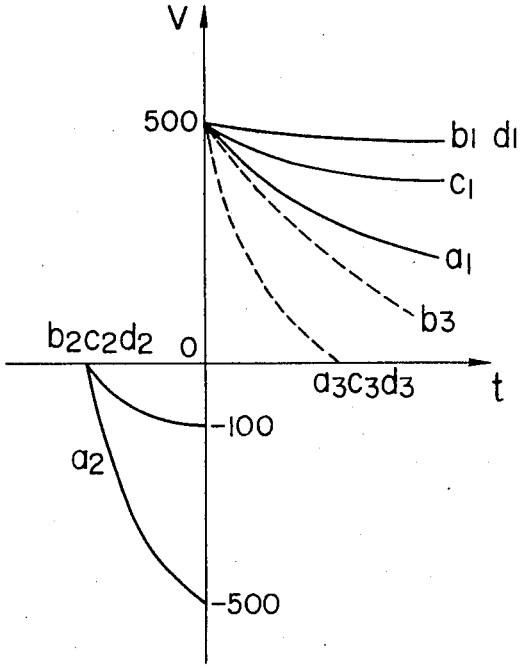
Figure 6:
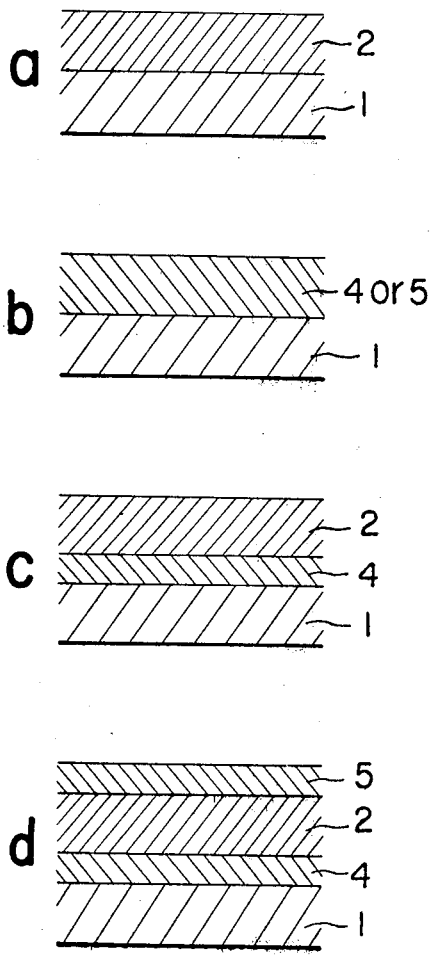
Figure 7:
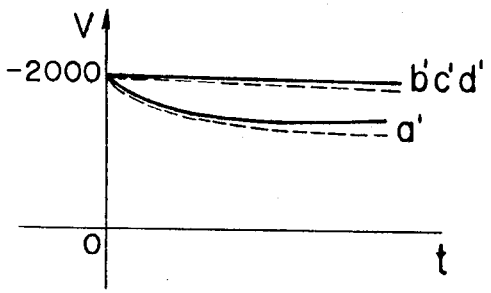

FIGS. $3a_1$, $3a_2$ and $3b_1$, $3b_2$ show changes of surface potentials of the photosensitive devices of FIGS. 2 and 1, respectively;

FIG. 4 is a graph showing the changes of surface potentials illustrated in FIG. 3;

FIG. 5 is a graph showing the change of surface potential of the photosensitive device illustrated in FIG. 6;

FIGS. *6a–6d* are diagrams for explaining use in the function of the intermediate layer;

FIG. 7 is a graph showing the change of surface potential for photosensitive devices which have a structure composed of an insulating layer overlaying the photosensitive devices as shown in FIGS. *6a–6d;*

Figure 8:
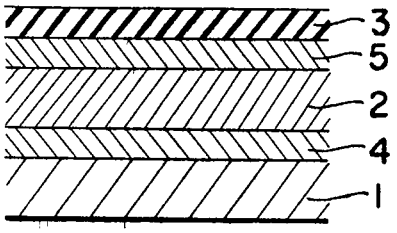

FIG. 8 is an enlarged diagrammatic cross-section of a further embodiment of photosensitive device according to this invention.

Referring now to FIG. 1, there is illustrated a conventional photosensitive device including a base 1, a photoconductive layer 2 superposed on the base 1, and an insulating layer 3 superposed on the photoconductive layer 2. When positive corona charging is applied to the photosensitive member, in the case where an n-type photoconductive layer is used, the surface of the insulating layer is positively charged and simultaneously a charge of negative polarity is bound in the photoconductive layer adjacent the interface between the photoconductive layer and the insulating layer. In this case, carriers formed in the base 1 are injected into the photoconductive layer 2, and the rate of injection depends on the properties of the photoconductive layer itself. If the injection is not sufficient, there is formed space charge, which is a cause of fatigue when the photosensitive member is repeatedly used, and decreased gradually the contrast of electrostatic images formed later. For the purpose of removing such disadvantages of conventional photosensitive members, according to this invention there is formed a state in which a charge is effectively injected from the base into the photoconductive layer. As illustrated in FIG. 2, when the photoconductive layer is of p-type material, a conductive layer of greater p-type concentration is formed at a portion 4 of the photoconductive layer 2 adjacent to the base 1, so that the portion 4 forms a p+ region. Hereinafter the layer 4 is called "intermediate layer". When the surface of the insulating layer 3 is given a negative charge by primary charging, the injection of hole from the base 1 to the photoconductive layer is, to a great extent, facilitated by the intermediate layer 4, and the negative and positive charges are so strongly bound through the insulating layer 3 that dark decay hardly occurs. Therefore, in the subsequent imagewise exposure simultaneously with discharging step are obtained electrostatic images of high contrast. In case of the photoconductive layer being of n-type, the intermediate layer is of more n-type one.

Examples of materials for the intermediate layer which facilitates injection of electric charge are shown below. As mentioned previously, it should be noted that the type of the intermediate layer is selected depending upon p-type or n-type of the photoconductive layer.

In case of p-type photoconductive layer, as the more p-type materials, there may be mentioned Se-Te alloy (preferred with Te content less than 5%), Se-As alloy, Se-As-Tl, and such like chalcogenides. Further, there may be used a vapor-deposited layer which contains halogen as an impurity capable of making Se moe p-type and is subjected to heat treatment to accelerate crystallization. If the degree of crystallization becomes too high, the formed film is apt to separate from the base. Therefore, the degree of crystallization is to be controlled appropriately depending upon the film thickness. It is not necessary that there is a clear boundary between the intermediate layer and the photoconductive layer, and the degree of crystallization or composition around the boundary therebetween may be continuously changed in place of abrupt change.

The film thickness is preferably $0.1\mu$–$10\mu$. At the thickness of less than $0.1\mu$ the uniformity of film is somewhat deteriorated and at the thickness of thicker than $10\mu$ the adherability is, to some extent, lowered.

When the photoconductive layer is of p-type material, the intermediate layer may be formed by a metal of high work function capable of forming an ohmic junction between the intermediate layer and the photoconductive layer, such as Pt and Ni, while for an n-type photoconductive layer there may be used metals of low work function such as In and Ga.

As the intermediate layer, there may be used a semiconductor of more p-type than the photoconductive layer, or there may be used a photoconductive insulating member such as a Ge vapor-deposited film or an $As_2Se_3$ layer. When the photoconductive layer is a relatively n-type one such as an Se-Te alloy containing a large amount of Te, a usual Se layer may be used as the intermediate layer.

The function of photoconductive layer 2 may be classified into two parts, i.e. absorption of light and resistant portion. Furthermore, the absorption of light can be taken over by absorption of short wave length light and absorption of long wave length light.

Therefore, a structure such as a multi-layer photoconductive layer and a modified multi-layer photoconductive layer may be used for such purpose.

As materials used as photosensitive layer for electrophotography, particularly, those obtained by vapor-deposition, there may be mentioned chalcogen element such as selenium and chalcogenide glass. Particularly, when the photoconductive layer is of n-type, a photoconductive material such as Se-Te alloy containing less than 5% of Se, and when the photoconductive layer is of p-type, a photoconductive material such as Se-Te alloy containing less than 5% of Te. Photoconductive members having volume resistivity at dark place of higher than $10^{11}\Omega$ cm is preferable and that of about $10^{12}$–$10^{13}\Omega$ cm is more preferable.

The film thickness is preferably 182 to $50\mu$. When the thickness is less than $1\mu$, the potential contrast of electrostatic latent images and the sensitivity are lowered and when the thickness is thicker than $50\mu$, the adherability becomes worse. However, when the photoconductive layer is that of multi-layer structure, the thickness is not necessarily restricted by such thickness range as above. In this case, a vacuum vapor-deposition method is most suitable for producing the layer. As far as the above-mentioned conditions are satisfied, any photoconductive materials may be used.

As the base 1, there may be used electroconductive materials such as metal plate, metal foil, and conventional base material subjected to a treatment for imparting electroconductivity. The photosensitive member having an intermediate layer as above is compared with a photosensitive member composed of a base, a photoconductive layer and an insulating layer illustrated in FIG. 1 in the following.

The electric charge states of a device according to this invention, and a device according to the prior art, are shown respectively in FIGS. $3a_1$, $3a_2$ and FIGS. $3b_1$, $3b_2$. With respect to the device according to this invention, the base 1 is kept at 70° C. and a Se-Te alloy containing 15% by weight of Te is vapor-deposited under vacuum to the thickness of about $3\mu$ (4 in FIGS. $3a_1$, $13a_2$) and kept, as it is, for 2 hours to crystallize and then kept at 60° C. during vapor-deposition of the above-mentioned alloy to the thickness of about $40\mu$, thereby forming the photoconductive layer 2 in FIGS. $3a_1$, $3a_2$.

With respect to a conventional photosensitive device, a base 1 as shown in FIGS. $3b_1$, $3b_2$ is kept at 65° C. and the alloy as mentioned-above is vapor-deposited under vacuum to the thickness of $40\mu$ and cooled to room temperature to form the photoconductive layer 2.

After taking out these plates, a polyethylene terephthalate film 3 of $25\mu$ thick is coated thereon as an insulating layer to complete the photosensitive devices. These photosensitive members are tested and compared as described below.

Aluminum bases of these photosensitive members are grounded, and corona discharging is applied to the insulating film to provide a negative charge and the change of the charging state during charging and after charging is measured by known measuring methods using a turntable and a surface potentiometer. The result is shown in FIG. 4 in which $t_1$ denotes the time of completion of charging and a and b denote the curves for photosensitive devices of FIGS. $3a_1$, $3a_2$ and FIGS. $3b_1$ and $3b_2$, respectively.

Thus, FIGS. $3a_1$–$3b_2$ illustrate the transfer of charge in the photosensitive devices corresponding to a and b in FIG. 4, respectively. FIG. $3a_1$ and $3b_1$ pertain to the states during charging of photosensitive devices a and b, respectively. Furthermore, FIGS. $3a_2$ and $3b_2$ correspond to the completed charge states of the photosensitive devices a and b, respectively. As is clear from these FIGS. and FIG. 4, the injection of charge from the base 1 in photosensitive device a upon primary charging is effected sufficiently, and positive and negative charges are strongly bound through insulating layer 3 and therefore, dark decay does not occur. On the contrary, in photosensitive device b the injection is not sufficiently effected and dark decay occurs after charging. Therefore, the photosensitive member according to this invention shows less dark decay than the conventional photosensitive member and thereby provides improved electrostatic images.

On the other hand, even if the injection of charge from the base is easily effected, when the charge thus injected is not retained strongly around the interface between the photoconductive layer and the insulating layer, the positive and the negative charges through the insulating layer are sparsely bound and thereby the potential contrast of the electrostatic latent image is lowered.

In general, a photoconductive layer of high sensitivity causes high dark discharging. Therefore, even if injection of charge upon primary charging is effected sufficiently, when the charge to be retained at dark place is largely discharged in the subsequent secondary charging step or in the discharging simultaneously with exposure step, the potential contrast of electrostatic latent image decreases. Therefore, discharging of charge bound around the interface between the photoconductive layer and the insulating layer should be prevented as far as possible.

For such purpose, it is necessary to retain the bound charge strongly by a barrier layer introduced positively as well as the surface barrier.

In the following, various comparisons are made referring to the photosensitive member having an intermediate and the photosensitive member having a layer for preventing discharging (hereinafter called "electric charge retaining layer").

FIGS. 6*a*–6*d* illustrate embodiment of such photosensitive members and FIG. 5 shows a charging-discharging characteristic diagram for the devices of FIGS. 6*a*–6*d*.

FIG. 6*a* shows a photosensitive member composed of a highly sensitive photoconductive layer 2 overlaying a conductive layer 1; FIG. 6*b* shows a photosensitive member composed of an intermediate layer 4 or electric charge retaining layer 5 overlaying or superposed on a conductive layer 1; FIG. 6*c* shows a photosensitive member composed of a photoconductive layer 2 and an intermediate layer 4 superposed on a conductive layer 1; and FIG. 6*d* shows a photosensitive member composed of an electric charge retaining layer 5, a photoconductive layer, and an intermediate layer superposed on a conductive layer 1.

When corona discharging is applied to the above-mentioned photosensitive devices shown in FIGS. 6*a*–6*d* to apply negative or positive charges, the charging and discharging characteristics are as shown in FIG. 5. Curves $a_1$–$d_1$ refer to a case of positively charging the respective devices in a dark place and then dark discharging; curves $a_2$–$d_2$ refer to a case of negatively charging in a dark place and then dark discharging; and curves $a_3$–$d_3$ refer to a case of positively charging in a dark place and then discharging in a light place. These results are obtained by measuring with an electrometer. The curves in FIG. 5 illustrate the following.

Photosensitive device of FIG. 6*a*:

The discharge in a light place is so large that the sensitivity is high, but the dark discharge is also large.

Photosensitive device of FIG. 6*b*:

The dark discharge is small, but the light discharge is also small and therefore, the sensitivity is low.

Photosensitive device of FIG. 6*c*:

The light discharge is large and therefore, the sensitivity is high, but the dark discharge is also relatively large.

Photosensitive device of FIG. 6*d*:

The light discharge is large and therefore, the sensitivity is high and furthermore, the dark discharge is small.

In view of the foregoing, it is understood that the photosensitive device of FIG. 6*d* has the best property suitable for electrophotographic processes.

The reason for the low dark discharge and high sensitivity of the photosensitive device of FIG. 6*d* is considered as follows. The barrier retaining positive corona ions of the electric charge retaining layer 5 is higher than that of the photoconductive layer 2 and further the intermediate layer 4 suppresses injection of electrons from the conductive layer 1. Furthermore, the highly sensitive photoconductive layer 2 is sensitive to a light having a wave length which is not absorbed by the electric charge retaining layer 5. Therefore, the photosensitive device composed of such composite layers is as sensitive as or more sensitive than a highly sensitive photosensitive device. The fact of higher dark discharge of the photosensitive member a than that of the photosensitive member c indicates the following matter. When the contact of Te in the photoconductive layer 2 of the photosensitive member a is high, there appears n-type tendency and there easily occurs injection of electron from the conductive layer 1. In the photosensitive member c the intermediate layer 4 seems to inhibit injection of electron from the conductive layer 1.

The reason for lower charge potential of the photosensitive members b–d than the photosensitive member a when they are negatively charged indicates that injection of hole from the conductive layer 1 is easily effected by means of the intermediate layer 4. The high charge potential of the photosensitive member a is seemingly due to the high content of Te in the photoconductive layer 2 as mentioned above.

FIG. 7 illustrates change of surface potential when negative charging is applied to photosensitive members a′, b′, c′ and d′ which are produced by providing an insulating layer on the surface of photosensitive members a, b, c and d, respectively. The solid line and the dot line represent dark discharging and light discharging, respectively. This graph shows that the intermediate layer is very effective.

In the photosensitive members b′–d′, hole is easily injected by the effect of the intermediate layer 4 upon charging, and the strong binding of the positive charge and the negative charge is maintained by means of the insulating layer, and thereby the surface potential is not varied after charging. On the contrary, in the photosensitive member a′ the injection of hole is not sufficiently effected upon charging, and further hole is injected only by the internal polarization of the already injected hole in the photoconductive layer 2. Therefore, in this case the dark decay appears as illustrated by curve a′ in FIG. 7 and the decay is further accelerated by light irradiation.

In view of the foregoing, it will be understood that the photosensitive member composed of a surface insulating layer, a photoconductive layer, an electric charge retaining layer overlaying an conductive layer according to this invention is excellent in various electrophotographic properties such as rectifying property, electric charge retaining property, sensitivity, contrast, panchromatic property and resolving power.

For the purpose of facilitating a pass of only one of electron and hole from the base through the photoconductive layer up to the interface between the insulating layer and the photoconductive layer or therearound. (i.e. passing directly the injected charge from the base by the primary charging up to the insulating layer interface.), it is preferable to provide a rectifying photoconductive layer since, upon A.C. discharge or charging to opposite polarity, the electric charge injected from the base is not transferred and the electric charge retained at the interface can not be neutralized.

In summary, the five-layer structure photosensitive member as shown in FIG. 8 is the most preferable one which is composed of a base, an intermediate layer 4, a rectifying photoconductive layer 2, an electric charge retaining layer 5 and an insulating layer 3.

As substances capable of passing only one of electron and hole, there may be mentioned p-type materials selected from chalcogenide glass series comprising mainly chalcogen elements, typically amorphous selenium, for example, Se-Te alloy, $AS_2S_3$, $AS_2Se_3$, $Sb_2S_3$, Se-AS-I alloy, Se-As-Tl alloy and mixtures thereof; n-type materials, for example, chalcogen compound of zinc or cadmium such as ZnS, ZnSe, CdS and CdSe, and the solid solution thereof; GeSe, $Cu_2O$, GeS or organic photoconductive substance such as anthracene; a material prepared by binding finely divided powders of these photoconductive materials with binder; glass ceramics prepared by dispersing uniformly fine crystals in glass phase by heat treatment of material comprising Pb0 33 parts, $SiO_2$ 9 parts and $A1_2O_3$ 3 parts.

The vapor-deposition method used for the material appropriately selected from these materials includes flashing method, co-vapor-deposition method and the like as well as a conventional method. If necessary, an appropriate impurity is added to control optionally the concentration of carrier in the desired value.

The electric charge retaining layer is provided for the purpose of strengthen the retaining of electric charge by positively introducing a barrier layer in addition to the surface barrier of the photoconductive layer which can retain electric charge at the interface between the photoconductive layer and the insulating layer. As the electric charge retaining layer, there may be used, for example, Se-Te alloy containing less than 6% Te when the photoconductive layer is of n-type and Se-Te alloy containing less than 6% Se when the photoconductive layer is of p-type. The photoconductive materials therefor may be selected from sources far wider than those for the rectifying photoconductive layer 3.

The photoconductivity referring to this electric charge retaining layer is to be broadly interpreted as compared with usual meaning of photoconductivity. In other words, it is judged on the basis of electric charge retaining property rather than electric conductivity, and it may contain insulating materials as well as semiconductor. The particularly important factor is that the life of minority carrier is so short that the electric charge can be sufficiently retained.

Therefore, it is not possible recite all concrete materials usable for electric charge retaining layer, but some of them are compounds of elements in Groups II–VI of the Periodic Table such as CdS and ZnS, remiconductor or photoconductive compounds of elements in Groups III–V of the Periodic Table, for example, chalcogen compounds such as GaAs and GaP, single element of Group IV such as Ge and Si, chalcogenide glass series such as amorphous chalcogen elements, metal oxides such as $Cu_2O$, insulating metal oxides such as indium oxide, inorganic substances such as lead glass, organic semiconductors, such as anthracene, carbazole, phthalocyanine and the like, and other organic compounds which are usually deemed as insulating material. To these materials may be added various additives.

As insulating layers, there may be used various organic acid tin layers. Representative ones are polyester film and fluorine contaning polymer film. These thin layers may be produced by adhering such thin resin film onto the electric charge retaining layer with an appropriate adhesive such as epoxy resin or coating the electric charge retaining layer with the resin as mentioned above. The thickness of the insulating layer may range from several microns to several tens microns, preferred with 10–30 microns. When the thickness is too thick, the resolving power is lowered and when the thickness is too thin, the mechanical strength decreases.

EXAMPLE 1

An aluminum base plate was heated at about 75 ° C., and thereupon an Se-Te alloy containing 10% tellurium was vapor-deposited for 30 minutes to form about 40 microns thick layer under such a condition that the temperature during deposition was kept not exceeding 85° C., and then allowed to cool. The resulting surface of vapor-deposited layer, was metallic luster smooth glassy phase. X-ray diffraction measurement of a portion of vapor-deposited layer upon aluminum plate results in a diffraction peaks showing a hexagonal crystal structure. This indicates that a portion close to the base plate was maintained at high temperature for comparatively long period and crystallization was accelerated.

Upon a surface of the vapor-deposited layer an insulating layer of polyethylene terephthalate was provided. The surface thereof was negatively charged as primary charge, and then, positively charged contemporaneously with irradiating a light image, if necessary, followed by a blanket irradiation to form an electrostatic latent image. The electrostatic contrast of the latent image thus obtained was remarkably higher than that obtained by a glassy phase photosensitive member which did not show a crystallization peak of X-ray diffraction measurement (for example, an Se-Te alloy containing 10% tellurium).

EXAMPLE 2

Se and Te powders having purities above 99.999% were employed.

(a) Selenium powders were sealed in a quartz ampoule at about $10^{-3}$ mmHg, kept at about 500° C. for 5 hrs. to melt and put in water to be rapidly quenched. Thus, there was obtained glassy Se (hereinafter called "$\alpha$").

(b) Powders containing selenium 85% and tellurium 15% by weight were ground and mixed in a ball mill for two days and the resulting mixture powder was sealed in a quartz ampoule at $10^{-3}$ mmHg, kept for 10 hours at about 500° C. to melt and put in water to be rapidly quenched producing a glassy Se-Te alloy (hereinafter called "$\beta$").

By using the above-mentioned $\alpha$ and $\beta$, the photosensitive members W, X, Y and Z were produced as described below.

A photosensitive member W:

The $\beta$ was vapor-deposited under vacuum upon an aluminum base plate of about 100 microns in thickness to form a layer of about 50 microns in thickness in such a condition that the pressure was about $10^{-5}$ mmHg, the temperature of a base plate was about 68° C. and the temperature of the vapor source was about 250° C. To the surface thereof was adhered polyethylene terephthalate film of 25 microns in thickness by an epoxy resin.

A photosensitive member X:

The $\alpha$ was vapor-deposited in vacuum upon an aluminum base plate of about 100 microns in thickness to form a layer of about 50 microns in thickness under such conditions that the pressure was about $10^{-5}$ mmHg, the temperature of a base plate was about 60° C. and the temperature of a vapor source was about 220° C. To the surface thereof was adhered a polyethylene terephthalate film of 25 microns in thickness by an epoxy resin.

A photosensitive member Y:

The $\alpha$ was vapor-deposited in vacuum upon an aluminum base plate of about 100 microns in thickness to form a layer of about 25 microns in thickness under the same condition as that for a photosensitive member X. Further the $\beta$ was vapor-deposited thereupon in vacuum to form a layer of about 25 microns in thickness in the same condition as that for a photosensitive member W. Upon the surface thereof a polyethylene terephthalate film of 25 microns in thickness was adhered by an epoxy resin.

A photosensitive member Z:

The $\alpha$ was vapor-deposited upon an aluminum base plate of about 100 microns in thickness to form a layer of about 25 microns in thickness under the same condition as that for a photosensitive member X, further thereupon the $\beta$ was vapor-deposited under the same condition as that for a photosensitive member W to form a layer of about 25 microns in thickness, furthermore thereupon the $\alpha$ was vapor-deposited under the condition as described above to form a layer of 1 micron in thickness. Upon a surface thereof a polyethylene terephthalate film of 25 microns in thickness was adhered by an epoxy resin. By using a white tungsten lamp (100 V. 500 W supplied by Kondo Electric Inc.) and wratten filters 25A (red), 58B (green) and 47B (blue), a photographic processing described in Japanese Patent Publication No. 24748/1968 was applied to the photosensitive members W, X, Y and Z described above. The result is shown in Table 1 below.

The exposure amount of irradiation was indicated by lux.sec. units, the potential contract between light and dark portions was represented by volt unit.

TABLE 1

| Photosensitive member | Exposure amount | Potential contrast | Exposure amount (25A) | Potential contrast | Exposure amount (58B) | Potential contrast | Exposure amount (47B) | Potential contrast |
|---|---|---|---|---|---|---|---|---|
| W | 2 | 200 | 2 | 100 | 0.8 | 120 | 1 | 100 |
| X | 2 | 200 | 2 | 20 | 0.8 | 150 | 1 | 120 |
| Y | 2 | 550 | 2 | 200 | 0.9 | 230 | 1 | 200 |
| Z | 2 | 800 | 2 | 300 | 0.8 | 450 | 1 | 400 |

The above table indicates that a photosensitive member Z of this invention comprising an intermediate layer and a charge retaining layer has a superior feature.

EXAMPLE 3

An original plate was prepared by adhering the cut wratten filters 25A, 58B and 47B of about 0.1 mm in width upon a transparent glass plate of 0.5 mm thick and the residual portions thereof being covered by a black paper, and red, green and blue negative toners (supplied by Canon Co.) were prepared.

An electrophotographic process similar to EXAMPLE 2 was applied to a photosensitive member Z of EXAMPLE 2 to produce the images corresponding to red, green and blue lines of the above mentioned original plate as described below:

(1) Firstly, the green and blue lines of the original plate were covered, and an electrostatic latent image for the red line was produced and developed with the above mentioned red negative toner by fur brushing method.

(2) Then, the red and blue lines of the original plate were covered and an electrostatic latent image for the green line was produced and developed with the said green negative toner by fur brushing method.

(3) Finally, the red and green lines were covered and an electrostatic latent image for the blue line was produced and developed with the said blue negative toner by fur brushing method.

Thus, there were obtained remarkably clear images colored with red, green and blue, which indicates that the photosensitive of this invention is advantageous in panchromatics and photosensitivity.

EXAMPLE 4

To a nickel plated brass base was vapor-deposited a selenium containing 5% tellurium by weight to form a layer of 40 microns in thickness. During depositing the temperature of the base was kept at about 70° C. To this deposited layer a polyester film of 12.5 microns in thickness was adhered by an epoxy resin to produce a photosensitive member.

The insulating surface of this photosensitive member was negatively charged in dark place to −1500V of surface potential as a primary charging by a corona discharging device charged at −6 KV, the charged photosensitive member was left in light place for a long period such as about 10 minutes, but any remarkable change of surface potential was not observed, and potential of −1500 V was maintained. The result of this test shows that an injection from the base plate was sufficiently effected

EXAMPLE 5

To an aluminum base plate maintained at about 70° C. Ge was vapor-deposited in vacuum to form a Ge layer of about 0.5 micron in thickness, and then, an $As_2Se_3$ was vapor-deposited under vacuum to form a rectification type photosensitive layer of about 4.0 microns in thickness. Further upon this layer, ZnS was vapor-deposited as a charge retaining layer to form a ZnS layer of about 0.5 micron in thickness. The prepared base plate was heated in air at 200° C. for 2 hours, and then, in a similar way to EXAMPLE 4, an insulating layer was adhered thereto to produce a photosensitive member. The result of the same testing method as EXAMPLE 4 shows that the injection from the base plate is satisfactory.

The photosensitive members of EXAMPLES 4 and 5 were compared with photosensitive members excluding an intermediate layer prepared under the same condition, the results are shown in Table 2 below.

With respect to an electrophotographic processing of sequent steps of primary charging, exposing together with oppositely charging, and uniform irradiating the whole surface of the photosensitive member, the features thereof were compared by the contrasts and the fatigues. A primary charging was carried out by a corona discharging device charged at −6.5 KV to charge −1700 V of surface potential, the exposure together with oppositely charging was effected by illumination of 10 lux at light portion, the exposure time being ½ second, oppositely charging being carried out by using a corona discharging devise charged at 6.5 KV. the contrast was measured as potential difference between the light and dark electrostatic latent images formed corresponding to light and black portions of original image, and the fatigue was measured as the decrease of contrast produced in processing described above at intervals of 3 minutes.

From this, it is clear that the photosensitive member of this invention for improving an injection from a base plate is suitable for an electrophotographic processing comprising a primary charging and a discharging contemporaneously with exposure.

TABLE 2

| | Contrast | Fatigue |
|---|---|---|
| Photosensitive member of EXAMPLE 4 | ~ 1,000$^V$ | undetected |
| The same member as above excluding the intermediate layer | ~ 800$^V$ | ~ 100$^V$ |
| Photosensitive member of EXAMPLE 5 | ~ 1,200$^V$ | undetected |
| The same member as above excluding the intermediate layer | ~ 800$^V$ | ~ 200$^V$ |

The present invention is explained referring to the EXAMPLES in which only a limited number of materials are disclosed, but in the present invention there may be used various other materials as the intermediate layer as far as the material can improve the injection from a base judging on the basis of the testing result determined by the test as described in EXAMPLE 4.

What is claimed is:

1. An electrophotographic process for forming a latent image comprising the steps of applying a primary charge to an electrophotographic photosensitive member comprising an electrically conductive base layer, an intermediate layer superposed on said conductive base layer, a layer of photoconductive material superposed on and having a thickness greater than said intermediate layer and an insulating layer superposed on said photoconductive layer, said primary charging step being performed by applying a negative charge to said insulating layer when said photoconductive layer comprises a p-type material and by applying a positive charge to said insulating layer when said photoconductive layer comprises an n-type material so that an electrical charge from said base is bound at the interface of said photoconductive layer and said insulating layer; subjecting said photosensitive member to corona charging of a polarity opposite to that of the primary charge or to AC discharging contemporaneously with imagewise exposure; and then subjecting said photosensitive member to blanket irradiation to increase the electrostatic contrast and form an electrostatic latent image of high contrast on said insulating layer;

wherein said intermediate layer has a greater p-type concentration than said photoconductive layer when said photoconductive layer comprises an p-type material, and a greater n-type concentration than said photoconductive layer when said photoconductive layer comprises an n-type material, to facilitate the injection of an electric charge from said base to said photoconductive layer.

2. A process according to claim 1, wherein said photoconductive layer comprises an Se-Te alloy containing up to about 15% Te.

3. A process according to claim 1, wherein said photoconductive layer is composed of an amorphous Se-Te alloy containing up to about 15% Te, and wherein said intermediate layer is composed of a crystallized Se-Te alloy containing up to about 15% Te.

4. A process according to claim 1, wherein said photoconductive layer is composed of an Se-Te alloy and wherein said intermediate layer is composed of a member selected from the group consisting of Ni, Ge, Pt, Se and an Se-Te alloy.

* * * * *

UNITED STATES PATENT AND TRADEMARK OFFICE

CERTIFICATE OF CORRECTION

PATENT NO. : 4,255,505

DATED : March 10, 1981

INVENTOR(S) : HIROSHI HANADA, ET AL.

It is certified that error appears in the above-identified patent and that said Letters Patent are hereby corrected as shown below:

Column 2, line 22, "for explaining use in the" should read --for use in explaining the--;

Column 3, line 13, "moe" should read --more--;
line 63, "182" should read --1μ--;

Column 4, line 21, "$13a_2$" should read --$3a_2$--;

Column 7, line 65, "tin" should read --thin--;

Column 9, line 37, "units" should read --unit--;

Column 11, line 5, "6.5KV. the" should read --+6.5KV. The--.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*